US006568844B1

(12) United States Patent
Årthun et al.

(10) Patent No.: US 6,568,844 B1
(45) Date of Patent: May 27, 2003

(54) DEVICE FOR IN-VESSEL TREATMENT

(75) Inventors: Nils Årthun, Öckerö (SE); Sten Johansson, Hisings-Kärra (SE); Håkan Samuelsson, Onsala (SE)

(73) Assignee: Novaseptic Equipment AB (SE)

( * ) Notice: Subject to any disclaimer, the term of this patent is extended or adjusted under 35 U.S.C. 154(b) by 0 days.

(21) Appl. No.: 09/600,548

(22) PCT Filed: Jan. 15, 1999

(86) PCT No.: PCT/SE99/00050

§ 371 (c)(1),
(2), (4) Date: Jul. 17, 2000

(87) PCT Pub. No.: WO99/36163

PCT Pub. Date: Jul. 22, 1999

(30) Foreign Application Priority Data

Jan. 19, 1998 (SE) ..... 9800107

(51) Int. Cl.[7] ..... B01F 7/28

(52) U.S. Cl. ..... 366/274; 366/314; 366/316; 366/608

(58) Field of Search ..... 366/274, 273, 366/247, 249, 251, 314, 315, 316, 317, 608; 241/91, 92, 93, 257.1, 273.3, 293; 416/178

(56) References Cited

U.S. PATENT DOCUMENTS

| | | | | |
|---|---|---|---|---|
| 574,282 A | * | 12/1896 | Sebastian | 366/315 |
| 2,825,542 A | * | 3/1958 | Jackson | 261/87 |
| 3,962,892 A | * | 6/1976 | Garlinghouse | 366/314 |
| 4,209,259 A | * | 6/1980 | Rains et al. | 366/273 |
| 4,716,021 A | * | 12/1987 | Akiyama et al. | 366/315 |
| 5,205,647 A | | 4/1993 | Ricciardi | 366/176 |
| 5,364,184 A | * | 11/1994 | Rains | 366/273 |
| 5,758,965 A | * | 6/1998 | Gambrill et al. | 366/273 |

FOREIGN PATENT DOCUMENTS

DE 3912190 11/1989

* cited by examiner

*Primary Examiner*—Tony G. Soohoo
(74) *Attorney, Agent, or Firm*—Orum & Roth

(57) ABSTRACT

The present invention relates to a device for treatment of material in a vessel, particularly for dispersion or homogenization of liquids, or for suspension of solids in liquids. The device comprises a treatment element that is rotationally mounted in the vessel and that has an essentially tubular configuration comprising two ends. The jacket of the treatment element has a plurality of cuts formed with sharp edges, which may be drawn through the material in the vessel as the treatment element rotates, in order to transfer shearing forces to said material. The shearing forces produce the desired treatment in the vessel.

17 Claims, 2 Drawing Sheets

Fig. 1
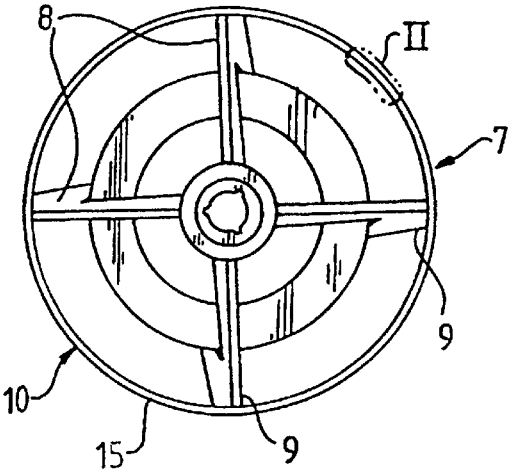
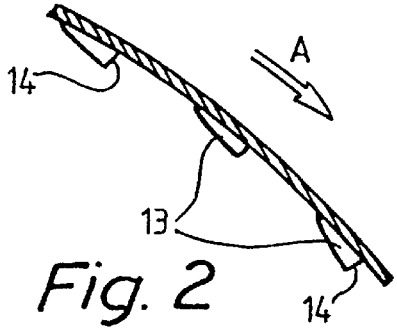
Fig. 2
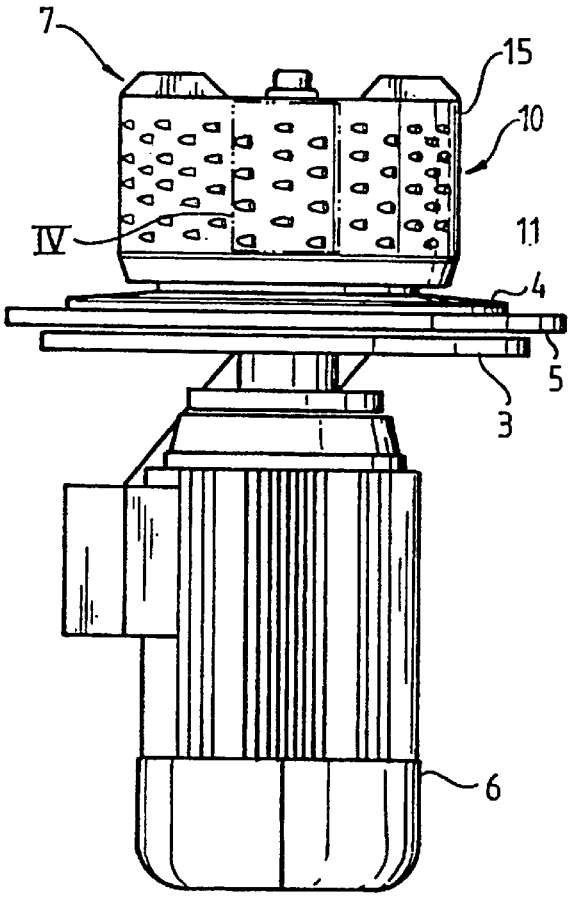
Fig. 3
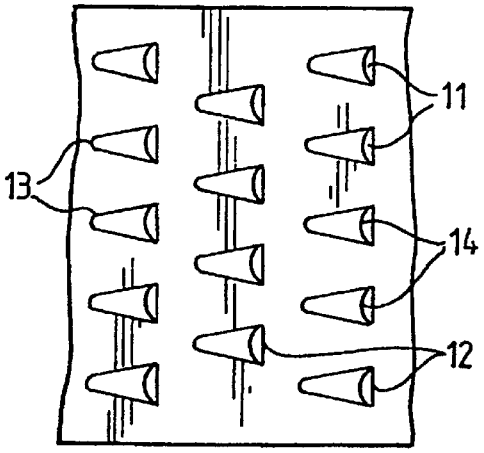
Fig. 4

DEVICE FOR IN-VESSEL TREATMENT

FIELD OF THE INVENTION

The present invention relates to a device for in-vessel treatment of material, particularly for dispersion or homogenisation of liquids, or for suspension of solids in liquids, of the kind comprising a treatment element that is rotationally mounted in the vessel.

BACKGROUND OF THE INVENTION

In mixing liquids in a vessel, a rotary stirrer usually is used, for example a stirrer having radially outwardly directed vanes. A stirrer of this kind is adapted to transfer energy to the liquid in two ways. Firstly, the liquid is set in motion as the vanes are drawn through liquid, whereby a laminar flow is created. Secondly, the liquid is affected by shearing forces at the vane edges, which causes turbulence.

In some situations, the mixing process is dependent on the presence of extremely strong shearing forces. This is true in the dispersion or homogenisation of liquids that do not spontaneously form a solution (for example oil in water) and in suspending powdered solids in a liquid (such as flour in water). The considerable shearing forces are required to break up for example drops of oil or lumps of flour into atomised particles through "whipping". When conventional stirrers are used, a very large moment of force is required to deliver shearing forces of this magnitude.

U.S. Pat. No. A 5,205,647 suggests a solution to the above problem. The mixing apparatus described therein has a cylindrical casing, in which is attached a sleeve formed with oblong slots, and a cylinder rotationally mounted in the casing. The cylinder is formed With through-botes extending in the cylinder material in parallel with the cylinder axis, and apertures extending between the bores and the exterior of the cylinder. The mixing apparatus operates by introducing liquids through two inlets while the cylinder is rotating. The liquids are introduced into the bores and thereafter are passed through the apertures to the exterior of the cylinder and thereafter through the oblong slots in the casing to finally exit through an outlet in the casing. On their route, the liquids are exposed to shearing forces.

In accordance with another prior-art apparatus two concentric cylinders are arranged to rotate relative to one another, for example inside a tank. The cylinders are formed with through-outlets and are disposed sufficiently closed to one another to ensure that a scissors-like force is produced, when they rotate relative to one another. Liquid subjected to this scissors-like force is affected by considerable shearing forces.

Several disadvantages are connected with the prior-art technique described above. The apparatuses comprise several components, which are movable relative to one another and between which the spacing by necessity must be extremely narrow if the large shearing forces are to be produced. The manufacturing tolerances as well as the assembly and mounting tolerances with respect to the discrete components therefore are extremely small.

Should some components happen to come into contact with one another during the rotation, there is a risk that particles may separate from the contacting components and pollute the liquid to be mixed therewith. In case of heavy contact, there is also a risk that the apparatus may be seriously damaged.

Considering the large number of components that must be produced, mounted and made to co-operate with a high degree of precision in order to produce the desired effect, the apparatuses become expensive to manufacture and to maintain.

In addition, the narrow spaces formed between the various components are difficult to clean. Particles and viscous liquid may get trapped in these narrow spaces and form obstructions, which impairs the functional ability of the apparatus

SUMMARY OF THE INVENTION

One object of the present invention is to provide a device for in-vessel treatment, which is capable of efficiently mixing, dispersing and/or homogenising liquids under the conditions outlined above without requiring a large moment of force. By "liquid" as used herein should be understood all fluid substances (media?) as also liquids/fluids containing solid particles.

A second object of the invention is to provide an easy-to-clean apparatus for in-vessel treatment.

A third object of the invention is to provide an apparatus for in-vessel treatment that does not require a large number of components that are movable relative to one another.

A fourth object of the invention is to provide an apparatus for in-vessel treatment that is inexpensive and simple to manufacture.

These and other objects are achieved according to the invention by means of an apparatus of the kind define in the introduction hereto and which is characterised in that the treatment element essentially is of tubular configuration and is formed with a plurality of cuts formed with sharp edges which are drawn through the material in the vessel as the treatment element rotates, in order to transfer shearing forces to said material.

Upon rotation of the treatment element in liquid, the sharp edges thereon generate a resistance force, as they move through the liquid. Because of the sharpness of the edges, the motion of the latter affects the liquid by means of shearing forces, and the moment of force required to rotate the treatment element consequently is transferred to a very high extent to the liquid in the form of shearing forces.

The treatment element preferably is cylindrical and is mounted for rotation about its centre axis. Resistance against the rotary motion then is generated almost exclusively from the sharp edges, since the rest of the treatment element is configured as a rotationally symmetrical element.

In addition, the treatment element can be configured as a multi-piece element. For example, it may be designed in the form of several cylinder sectors, or in the form of several concentric cylinders. In addition one or both ends of the treatment element may be formed with inwardly directed flanges. Alternatively, the treatment element may be formed with a barrel-shaped contour configuration, presenting smaller radii at its ends than in its in-between parts. Owing to this configuration, it becomes more difficult for liquid that is forced against the jacket of the treatment element to flow axially along the jacket of the treatment element and across the edge of the latter, and in consequence thereof the liquid is instead forced to pass through the cuts.

In addition, the cuts may be formed with shovel means the mouths of which are orientated in the direction of rotation of the treatment element, which mouths are formed with sharp edges. Preferably, the shovel means are formed on the inner face of the treatment element. In the course of rotation of the element, the shovel means urge liquid to pass from the inner face of the treatment element, through the cuts to the external face of the treatment element. In addition, the shovel means contribute to setting the liquid in a rotary motion, whereby the centripetal force will convey liquid radially outwards, towards and through the cuts formed in the jacket of the treatment element. Altogether, a pumping action is produced, which makes liquid flow past the sharp edges.

Preferably, the treatment element is fitted on a stirrer or mixer having several radially outwardly directed vanes. Preferably, the treatment element is mounted on the tips of the vanes, whereby the treatment element will form a cylindrically shaped enclosure around the stirrer/mixer. The vanes generate a rotary motion of the liquid in consequence whereof the centripetal force will transport liquid and particles radially outwards, away from the hub of the stirrer/mixer. The flow through the cuts, and thus the flow past the sharp edges, therefore will be larger.

BRIEF DESCRIPTION OF THE DRAWINGS

The invention will be described in more detail in the following with reference to the accompanying drawings, wherein FIG. 1 is a view from above of a presently preferred embodiment of the device in accordance with the invention, FIG. 2 is an enlarged view of the area marked II in FIG. 1, FIG. 3 is a lateral view of the device of FIG. 1, mounted on an electric motor, FIG. 4 is an enlarged view of the area marked IV in FIG. 3.

DESCRIPTION OF A PREFERRED EMBODIMENT

Figure 5:
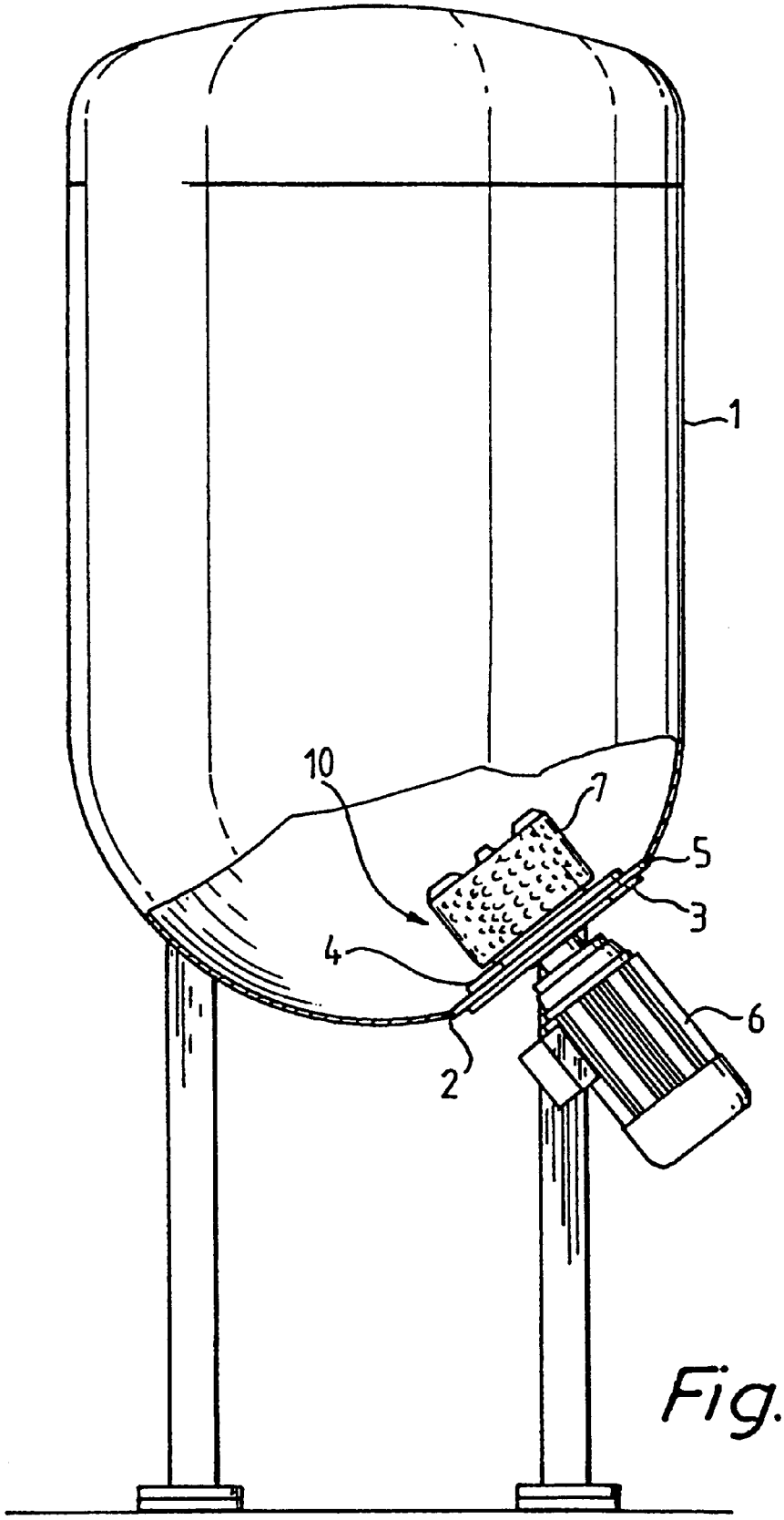
FIG. 5 is a longitudinal sectional view through a vessel fitted with a device according to FIG. 3 and located at the vessel bottom.

FIG. 5 illustrates a vessel intended for mixing liquids, preferably a tank 1 made from sheet metal or plastic, preferably stainless steel or the like. The tank 1 is formed with a circular opening 2, in which is mounted a circular disk 3 having a male coupling 4, which projects into the tank interior. A flange 5 is attached, preferably by means of welding, to the rim of the opening 2 so as to extend peripherally around the disk.

Furthermore, the disk 3 is attached, for examples by means of screws, to a preferably electric motor 6, the shaft of which extends from the outer face of the tank 1 and is connected to a male coupling 4. Inside the tank, a stirrer 7 is rotationally mounted on the male coupling 4, said stirrer arranged to receive moment of force from the motor 6 by way of a magnetic drive of known configuration.

The motor 6 need not be electrically driven but alternatively could be e.g. pneumatically or hydraulically driven. In addition, the motor 6 may drive the stirrer 7 directly, i.e. not via a magnetic drive, and furthermore a gearbox may be inserted between the motor and the stirrer in order to provide the desired gear ratio between the rotational speeds of the stirrer and the motor, respectively. Instead of the motor 6 being positioned as illustrated it may be spaced from the tank 1 and drive the stirrer 7 for example by a belt-drive arrangement or some similar type of force transmission.

The stirrer 7 is formed with radially outwardly projecting vanes 8, which are mounted at a slight angle axially. On the ends 9 of the vanes, a treatment element 10 in accordance with the present invention is attached, preferably by means of welding.

In accordance with the preferred embodiment, the treatment element 10 is configured as a cylindrical ring 1, which preferably is made from thin sheet metal, preferably stainless steel of the like. The jacket 15 of the cylinder 10 is formed with a number of through-holes 11 having sharp edges 12. In accordance with the preferred embodiment, the holes 11 are arranged in axially extending rows alternatingly comprising five and four holes.

The cylinder 10 may be produced for example by punching the holes 11 from a sheet-metal strip, the long sides of which are thereafter bent into an annular shape. Therefore, the joint formed along the contacting short sides of the bent strip can be welded together.

The holes could also consist of the meshes in a net produced by expanding a material, in which through-slits have been made, which after the expansion form the sharp edges.

On the inner face of the cylinder 10, at each hole 11, shovels 13, having sharp edges 14, are formed.

Preferably, these shovels 13 are formed in conjunction with the punching of the holes 11.

When the motor 6 drives the stirrer 7, as mentioned previously by magnetic drive or the like, the cylinder 10 is being rotated about its centre axis. This draws the shovels 13 through the liquid, the shovel mouths being orientated in the direction of rotation A, and the sharp shovel edges 14 transfer part of the moment of force of the stirrer 7 to the liquid in the form of a shearing force. The shovels 13 transport the liquid further, from the inner face of the cylinder 10, through the holes 11 in the jacket 15 and to the exterior of the cylinder 10. The sharp edges 12 of the holes 11 transfer shearing forces to the liquid in the same manner as do the sharp edges 14 of the shovels 13.

The vanes 8 of the stirrer 7 set the liquid in a rotary motion, whereby the liquid pressed outwards by the centripetal force, against the jacket of the cylinder. The rotary motion is strengthened at the inner face of the cylinder 10, where the shovels 13 contribute to setting the liquid in rotation.

In all, a pumping effect is created, causing liquid enclosed by the rotating cylinder 10 to be kept rotating and consequently to be forced by the centripetal force outwards, against the inner face of the cylinder 10. The shovels 13 contribute to this effect and then transport the liquid from the inner face of the cylinder 10, through the holes 11, to the exterior of the cylinder 10. During this transport, the sharp edges 14 of the shovel mouths and the sharp hole edges 12 transfer part of the moment of force of the stirrer 7 to the liquid in the form of shearing forces.

The shearing forces cause efficient mixing of liquids, also in the case of dispersion or homogenisation of liquids that do not easily form solutions, as also in the case of suspension of solids in liquid.

It will be appreciated that several modifications may be made to the embodiment described above within the scope of protection as defined in the appended claims.

For example, the positions of the holes as well as their numbers could be varied. In addition, a shovel may be configured so as to extend across several holes.

Furthermore, the cylinder may be shaped as a barrel or be formed with inwardly directed flanges at one or both ends, thus to counteract the tendency that liquid be forced to move axially along the jacket but instead be made to pass through the holes.

The treatment element could also consist of several parts, such as a number of concentric cylinders.

What is claimed is:

1. A device for treatment of material in a vessel (1), particularly for dispersion or homogenisation of liquids, or for suspension of solids in liquids, of the kind comprising a treatment element (10) that is rotationally mounted in the vessel (1), characterized in that the treatment element (10) essentially is of tubular configuration and is formed in a jacket (15) with a plurality of cuts (11) formed with sharp edges (12), which are drawn through the material in the vessel as the treatment element rotates, in order to transfer shearing forces to said material wherein said treatment element is enveloped by said material and at least one of the ends of the treatment element (10) is formed with an inwardly directed flange.

2. A device as claimed in claim 1, characterized in that the treatment element (10) has a barrel-shaped contour configuration.

3. A device as claimed in claim 1, characterized in that the cuts (11) are formed with shovel means (13), the mouths of which are orientated in the direction of rotation (A) of the treatment element, said mouths being formed with sharp edges (14).

4. A device as claimed in claim 1, wherein the treatment element (10) preferably is cylindrical and is mounted for rotation about its center axis.

5. A device as claimed in claim 1, wherein the treatment element (10) is divided into at least two separate pieces.

6. A device for treatment of material in a vessel (1), particularly for dispersion or homogenisation of liquids, or for suspension of solids in liquids, of the kind comprising a treatment element (10) that is rotationally mounted in the vessel (1), characterized in that the treatment element (10) essentially is of tubular configuration and is formed in a jacket (15) with a plurality of cuts (11) formed with sharp edges (12), which are drawn through the material in the vessel as the treatment element rotates, in order to transfer shearing forces to said material wherein said treatment element is enveloped by said material and the treatment element (10) has a barrel-shaped contour configuration.

7. A device as claimed in claim 6, characterised in that the cuts (11) are formed with shovel means (13), the mouths of which are oriented in the direction of rotation (A) of the treatment element, said mouths being formed with sharp edges (14).

8. A device as claimed in claim 6, wherein the treatment element (10) preferably is cylindrical and is mounted for rotation about its center axis.

9. A device as claimed in claim 6, wherein the treatment element (10) is divided into at least two separate pieces.

10. A device for treatment of material in a vessel (1), particularly for dispersion or homogenisation of liquids, or for suspension of solids in liquids, of the kind comprising a treatment element (10) that is rotationally mounted in the vessel (1), characterized in that the treatment element (10) essentially is of tubular configuration and is formed in a jacket (15) with a plurality of cuts (11) formed with sharp edges (12), which are drawn through the material in the vessel as the treatment element rotates, in order to transfer shearing forces to said material wherein said treatment element is enveloped by said material, wherein the cuts are the meshes of a net formed by expanding a material, in which through-slits have been made, said slits forming said sharp edges.

11. A device for treatment of material in a vessel (1), particularly for dispersion or homogenisation of liquids, or for suspension of solids in liquids, of the kind comprising a treatment element (10) that is rotationally mounted in the vessel (1), characterized in that the treatment element (10) essentially is of tubular configuration and is formed in a jacket (15) with a plurality of cuts (11) formed with sharp edges (12), which are drawn through the material in the vessel as the treatment element rotates, in order to transfer shearing forces to said material wherein said treatment element is enveloped by said material and the treatment element (10) is fitted on a stirrer (7) having vanes thereon, said stirrer arranged to be driven via magnetic drive by a drive means (6) situated on the exterior of the vessel (1).

12. A device as claimed in claim 11, characterised in that the vanes (8) of the stirrer (7) are directed radially outwardly, and in that the treatment element 10 is mounted on the outer ends (9) of these vanes (8).

13. A device for treatment of material in a vessel (1), particularly for dispersion or homogenisation of liquids, or for suspension of solids and liquids, of the kind comprising a treatment element (10) that is rotationally mounted in the vessel (1), characterized in that the treatment element (10) essentially is of tubular configuration and is formed in a jacket (15) with a plurality of cuts (11) formed with sharp edges (12), which are drawn through the material in the vessel as the treatment element rotates, in order to transfer shearing forces to said material;

wherein the cuts (11) are formed with shovel means (13), the mouths of which are all orientated in the direction of rotation (A) of the treatment element, said mouths being formed with sharp edges (14).

14. A device as claimed in claim 13, characterised in that the shovel means (13) are positioned on the inner face of the jacket (15).

15. A device as claimed in claim 13, wherein the treatment element (10) preferably cylindrical and is mounted for rotation about its Center axis.

16. A device as claimed in claim 13, wherein the treatment element (10) is divided into at least two separate pieces.

17. A device for treatment of material in a vessel (1), particularly for dispersion or homogenisation of liquids, or for suspension of solids and liquids, of the kind comprising a treatment element (10) that is rotationally mounted in the vessel (1), characterized in that the treatment element (10) essentially is of tubular configuration and is formed in a jacket (15) with a plurality of cuts (11) formed with sharp edges (12), which are drawn through the material in the vessel as the treatment element rotates, in order to transfer shearing forces to said material;

wherein the treatment element (10) is cylindrical, is mounted for rotation about its center axis, is divided into at least two separate pieces, has a barrel-shaped contour configuration, is fitted on a stirrer (7) having vanes thereon, said stirrer arranged to be driven via magnetic drive by drive means (6) situated on the exterior of the vessel (1) wherein the vanes (8) of the stirrer (7) are directed radially outward, and the treatment element is mounted on the outer end (9) of these vanes (8) and at least one of the end of the treatment element (10) is formed with an inwardly directing flange;

and the cuts (11) are formed with shovel means (13), the mouths of which are orientated in the direction of rotation (A) of the treatment element, said mouths being formed with sharp edges; and wherein the shovel means (13) are positioned on the inner face of the jacket (15).

* * * * *